United States Patent [19]

Meiners

[11] Patent Number: 4,505,234

[45] Date of Patent: Mar. 19, 1985

[54] WET SLEEVE MOUNTING SYSTEM FOR SLEEVE CYLINDERS OF INTERNAL COMBUSTION ENGINES

[75] Inventor: Elmo R. Meiners, Anchor, Ill.

[73] Assignee: M & W Gear Company, Gibson City, Ill.

[21] Appl. No.: 450,525

[22] Filed: Dec. 17, 1982

[51] Int. Cl.[3] ..... F02F 1/10

[52] U.S. Cl. ..... 123/41.84; 123/193 C

[58] Field of Search ..... 123/41.84, 193 C, 193 R

[56] References Cited

U.S. PATENT DOCUMENTS 4,273,835 6/1981 Huguchi ..... 123/41.84

4,399,783 8/1983 Hauser ..... 123/41.84

FOREIGN PATENT DOCUMENTS 12607 3/1934 Australia ..... 123/41.84

2028424 3/1980 United Kingdom ..... 123/193 C

*Primary Examiner*—Craig R. Feinberg

*Attorney, Agent, or Firm*—Allegretti, Newitt, Witcoff & McAndrews Ltd.

[57] ABSTRACT

A wet sleeve insert in an internal combustion engine cylinder bore includes a circular conductive ring or spring which is inserted between the sleeve and the engine block to ensure conduction of electrostatic current to thereby prevent electrostatic pitting on the surface of the wet sleeve and ultimate cavitation of coolant flowing about the sleeve.

2 Claims, 4 Drawing Figures

WET SLEEVE MOUNTING SYSTEM FOR SLEEVE CYLINDERS OF INTERNAL COMBUSTION ENGINES

BACKGROUND OF THE INVENTION

This invention relates to an improved construction for an internal combustion engine and more particularly to an improved construction for a wet sleeve insert in a cylinder block for an internal combustion engine.

In large internal combustion engines, typically an engine cylinder block is fitted with cylinder sleeves that project into bores cut into the block. The sleeves are usually sealed at opposite ends to the block. An open volume or passage is defined around the sleeve intermediate the ends for flow of coolant. When such an engine is operating, the differential expansion of the block relative to the sleeve, the flow of coolant about the sleeve, the vibration of the engine and other factors may cause electrolytic pitting of the outside surface of the cylinder sleeve in the coolant passage. This pitting may further cause cavitation of coolant as it flows about the sleeve which, in turn, may produce hot spots in the cylinder sleeve and general degradation of the operation of the engine.

Various suggestions have been made for elimination of electrolytic pitting of the outside surface of the sleeve. One such suggestion provides for boring a hole through the block adjacent each sleeve. A copper bolt or other conductor is then threaded through the block against the region of the sleeve which becomes pitted. The copper bolt acts as a conductor to alleviate the electrolytic pitting of the outside surface of the sleeve by conducting static electricity away from that surface.

While arrangement of a conductive rod from the sleeve to the engine block has proven to be useful, it does become time consuming and expensive to modify or adapt each cylinder in an engine block with such a conductor. The present invention contemplates an improved construction for elimination of pitting due to electrolytic action.

SUMMARY OF THE INVENTION

Briefly, the present invention comprises the improvement in an internal combustion engine, of the type having an engine block with insertable cylindrical wet sleeves, of a conducting ring which is fitted about an end section of the sleeve. The conducting ring is compressed between the sleeve and the cylinder bore in the block to provide continuous, circumferential electrical contact between the sleeve and the block to more effectively ground the sleeve and prevent electrolytic pitting of the outside surface of the sleeve.

Thus, it is an object of the invention to provide an improved insertable wet sleeve for an internal combustion engine.

A further object of the invention is to provide an improved cylindrical sleeve construction which incorporates a circumferential conductor that alleviates electrolytic pitting of the outside surface of the sleeve.

A further object of the present invention is to provide a sleeve construction for use with an engine block which diminishes cavitation of coolant fluid in the region of coolant flow about a wet sleeve inserted in an engine block.

Another object of the invention is to provide an improved wet sleeve construction for an engine block wherein electrolytic pitting of the outside surface of the sleeve is prevented in an economical and mechanically improved manner.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
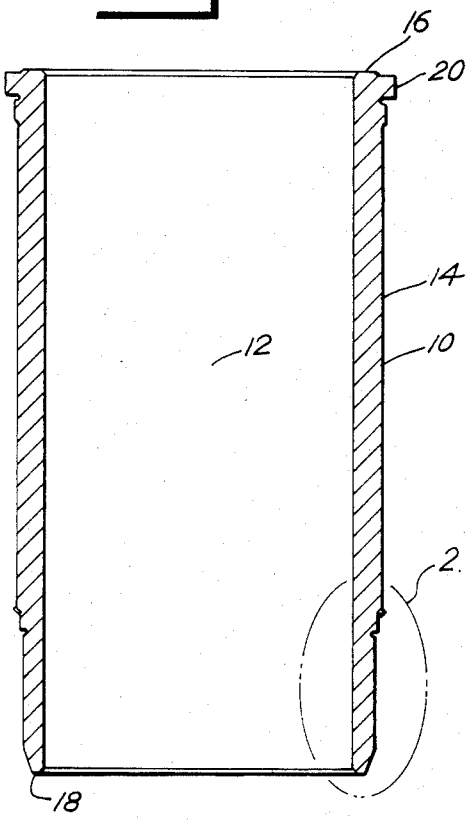
FIG. 1 is a side cross sectional view of a first embodiment of an improved sleeve construction incorporating the present invention.
Figure 2:
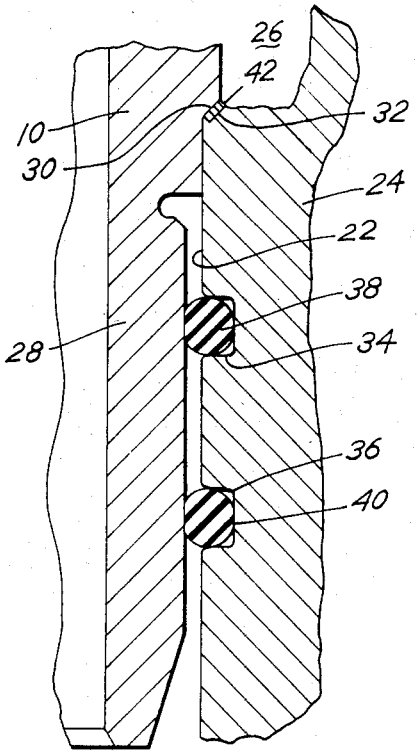
FIG. 2 is an enlarged side cross sectional view of a portion of FIG. 1 illustrating the sleeve in a cylinder bore.
Figure 3:
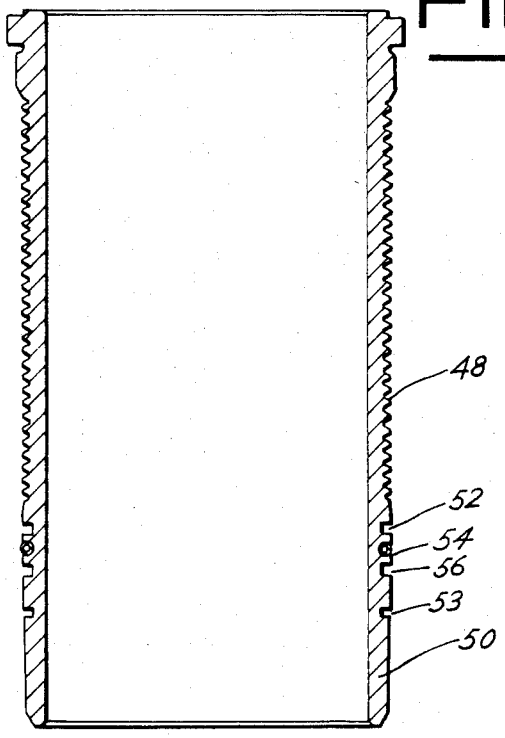
FIG. 3 is a side cross sectional view of a second embodiment of the invention.
Figure 4:
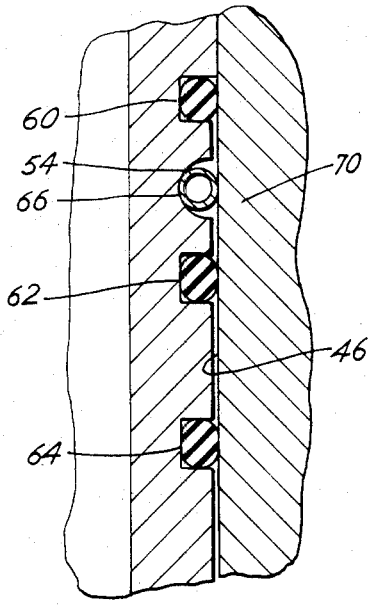
FIG. 4 is an enlarged side cross sectional view of the embodiment of FIG. 3 in a bore in an engine block.

FIGS. 1 and 2 illustrate a first embodiment of the present invention. FIGS. 3 and 4 illustrate a second embodiment.

Referring first to FIGS. 1 and 2, a cylindrical wet sleeve 10 includes an inner surface 12, an outer surface 14, a top end 16 and a bottom end 18. The sleeve 10 is open at both ends. A circumferential flange 20 is defined about the top end 16. The inside surface 12 is shaped to receive and cooperate with a piston of an internal combustion engine.

The sleeve 10 is inserted in a bore 22 defined in an engine block 24. A fluid flow passage 26 in FIG. 2 is defined by a space between the sleeve 10 and the block 24. The top flange 20 seats against the block 24 to close off the top of the passage 26. The bottom of the sleeve 10 defines a lower perimeter section or bottom perimeter section 28 which cooperates with a restricted counterbore 22 of block 24 and seals the lower end of the passage 26. When the engine operates, coolant flows in passage 26.

In the embodiment shown in FIGS. 1 and 2, the sleeve 10 includes a reduced outside diameter or lower perimeter section 28 defining a flange 30 which cooperates with a land 32 defined by the block 24. The block 24 also includes, within the counterbore 22, first and second circumferential grooves 34, 36 which receive elastomeric O-rings 38, 40, respectively. The O-rings 38, 40 are compressed by the lower perimeter section 28 of the sleeve 10. A circular copper ring 42 is inserted in the space between the flange 30 and land 32. The ring 42 provides for conduction of electrostatic current from the region at the lower end of the sleeve 10. In this manner, when coolant is circulated in the passage 26 during the operation of the engine, electrostatic current generated particularly at the lower end of the sleeve 10 is conducted from the sleeve 10 through the copper ring 32 to block 24. This prevents electrostatic pitting and erosion a the lower end of surface 14 in the passage 26. As a result, cavitation of cooling fluid flowing through the volume 26 is prevented. This, in turn, prevents formation of hot spots and further exacerbation of the problem of pitting. It also enhances the efficiency of the engine.

FIGS. 3 and 4 illustrate another construction wherein the pitting due to electrostatic current is inhibited. FIG. 3 illustrates a configuration for a sleeve 48 which cooperates with a bore 46 in a cylinder block 70 in the same manner as previously described in FIGS. 1 and 2. In the embodiment of FIG. 4, a smooth, constant diameter bore 46 cooperates with the bottom or lower perimeter section 50 of a sleeve 48. In the embodiment shown then, the sleeve 48 includes a bottom perimeter section 50 which includes a series of four circumferential grooves 52, 54, 56, 58. Elastomeric O-rings 60, 62, 64 fit in the grooves 52, 56, 58. A spiral wound copper spring in the form of a closed loop 66 is inserted or fitted in the groove 54. The diameter of the spring 66 is greater than the depth of the groove 54. In this manner the spring 66 projects beyond the perimeter or surface of the sleeve 48 and will compress against the block 70 to provide for electrical contact between the sleeve 48 and block 70. Again, in this manner, conduction of static electricity from the sleeve 48 is assured to thereby prevent pitting on the outside surface of the sleeve in the region intermediate the ends of sleeve 48 where coolant flows between sleeve 48 and block 70. Prevention of electrostatic pitting promotes elimination of cavitation of coolant in the region between the sleeve 48 and the block 70.

It will be noted with each of the embodiments that a circular closed loop conductive member is inserted adjacent an end of the sleeve. Thus, while there has been set forth preferred embodiments of the invention, it is to be understood that the invention will be limited only by the following claims and their equivalents.

What is claimed is:

1. In an internal combustion engine of the type including a cylinder block, said block having cylinder bores for receipt of separate cylinder sleeves, each of said separate sleeves having a circumferential side surface, a top perimeter and a bottom perimeter section, said side surface being spaced from the bore to provide a fluid passage for coolant intermediate the top perimeter and bottom perimeter section, said top perimeter and bottom perimeter section being sealed to the block to prevent leakage of coolant from the passage, the improvement of means to simultaneously support the sleeve and for insuring electric conduction between the sleeve and block at the bottom perimeter section to prevent electrolytic pitting of the sleeve and attendant cavitation of coolant in the passage, said means comprising a circumferential flange on the sleeve at the bottom perimeter section; a circumferential land in the bore of the block opposed to the flange of the sleeve by maintaining the flange in overlaying relation to the land; and a circumferential conductive metal ring member compressed between the flange and land, said land, ring member and flange defining a conduction path, said land defining a support surface for the sleeve.

2. The improvement of claim 1 including an elastomeric seal between the sleeve and bore at the bottom perimeter section in separate grooves spaced from the conductive metal ring.

* * * * *